US005595806A

United States Patent [19]

Korfmacher

[11] Patent Number: 5,595,806

[45] Date of Patent: Jan. 21, 1997

[54] MAT FOR BEARING AND SUPPORTING OBJECTS, ESPECIALLY FOR PACKAGING

[75] Inventor: Georg Korfmacher, Munich, Germany

[73] Assignee: Karfmacher Trading GmbH, Munich, Germany

[21] Appl. No.: 918,785

[22] Filed: Jul. 27, 1992

Related U.S. Application Data

[63] Continuation of Ser. No. 603,468, Oct. 25, 1990, abandoned.

[30] Foreign Application Priority Data

| | | | |
|---|---|---|---|
| Apr. 30, 1988 | [DE] | Germany | 8805735 U |
| May 18, 1988 | [DE] | Germany | 8806523 U |
| Dec. 29, 1988 | [DE] | Germany | 8816163 U |
| Feb. 11, 1989 | [XH] | Hague Agreement | WO89/10315 |

[51] Int. Cl.[6] ..... B32B 3/06

[52] U.S. Cl. ..... 428/69; 206/521; 206/522; 206/523; 206/524; 206/524.8; 229/87.01; 229/87.02; 428/68; 428/71; 428/76; 5/655.3; 5/712

[58] Field of Search ..... 428/68, 69, 71, 428/76; 206/521–524, 524.8; 5/481, 480, 449, 465; 383/3; 229/87.02, 87.01; 602/6, 13

[56] References Cited

U.S. PATENT DOCUMENTS

| | | | |
|---|---|---|---|
| 3,212,497 | 10/1965 | Dickinson | 128/87 R |
| 4,405,129 | 9/1983 | Stuckey | 5/449 |
| 4,409,271 | 10/1983 | Pehr | 428/71 |
| 4,450,193 | 5/1984 | Staebler | 428/71 |
| 4,675,930 | 6/1987 | Sargent | 5/449 |
| 4,795,666 | 1/1989 | Okada | 428/71 |
| 4,906,502 | 3/1990 | Rudy | 428/71 |
| 4,963,408 | 10/1990 | Huegli | 428/71 |

FOREIGN PATENT DOCUMENTS

| | | | |
|---|---|---|---|
| 1108965 | 1/1956 | France . | |
| 2018605 | 4/1970 | Germany . | |
| 3320307A1 | 12/1984 | Germany . | |
| 8415642 U | 10/1985 | Germany . | |
| 1574093 | 9/1980 | United Kingdom | 428/71 |
| 2148093 | 5/1985 | United Kingdom . | |
| WO87/06209 | 10/1987 | WIPO . | |

*Primary Examiner*—Nasser Ahmad

*Attorney, Agent, or Firm*—Armstrong, Westerman, Hattori, McLeland & Naughton

[57] ABSTRACT

The mat disclosed has an air-tight flexible envelope closable by means of a valve and filled with a granular filling material. The filling material is lodged in a fabric sack made from a spacing fabric. The filling material is a composite body composed of at least two materials having different mechanical properties.

17 Claims, 2 Drawing Sheets

MAT FOR BEARING AND SUPPORTING OBJECTS, ESPECIALLY FOR PACKAGING

This application is a continuation of application Ser. No. 07/603,468 filed Oct. 25, 1990 now abandoned.

BACKGROUND OF THE INVENTION

1. Field of the Invention

The present invention relates to mats for bearing and supporting objects, especially for packaging purposes, comprising an air tight, flexible case which can be closed by a valve and which contains an appropriate filling material.

2. Description of Prior Art

In the known mats of this kind, the filling material consists preferably of a pre-expanded granules of polystyrene. In the known realization described in the U.S. Pat. No. 3,212,497, the granules are filled up in a textile bag. With such realization, there is the risk that the granules, especially when held vertically in pressureless condition, accumulate in the lower part of the bag while the upper part of the bag is empty of granules. When using this mat, the granules first have to be evened out before applying the vacuum. The DOS 2.018.605 reference describes a solution where the granules are captured in segments of the case (FIG. 5) in such a way that the air can be drawn out of the segments without any escape or exchange possible of the granules between the segments. The PCT/FR87/00115 suggests an embodiment of such a realization with segments where the granules are captured in padded or tube-shaped segments (FIGS. 5 and 8).

The problems of the known mats reside in a conflict of objectives. On one hand, a loose fill of granules as described in the U.S. Pat. No. 3,212,497 is desirable in as much as the granules are constantly mixed when the mat is pressureless. On the other hand, the uncontrolled accumulation of granules in one area of the mat in a pressureless condition is not desirable because of the enhanced handling of the mat. The capturing of the granules in segments or tubes has the disadvantage that certain areas and especially the central areas of the mat suffer a special mechanical stress and cannot regenerate sufficiently while pressureless, as there is no exchange of granules between the central and the marginal areas. So, especially with the embodiment described in PCT/FR87/00115, a sensible shrinkage of the granules takes place in the central segments or tubes after a relatively short time and, consequently, undesirable thin spots show up in the mat. These thin spots or areas cannot be evened out or smoothened for a reliable use of the mat. Another common disadvantage of the known mats resides in the fact that thin spots or areas are built along the separation lines of the segments or tubes. This, however, is very disadvantageous for the goods to be packed as the apparent thickness of the mat, in fact, does not exist. This defect cannot be detected or seen from the outside.

DESCRIPTION OF PREFERRED EMBODIMENTS

It is, therefore, one object of the present invention to avoid the disadvantages of the known mats and to provide a mat where the above mentioned conflict of objectives is solved in a particularly simple and economical manner. The invention suggests that the granules are captured in a bag as a loose fill, so that they are susceptible to be mixed permanently by the normal manipulation of the mat, but that there is no possibility of area—or spotwise accumulation or emptying of the mat in a pressureless condition.

Another disadvantage of the known mats is that they cannot be alternatively put under pressure or vacuum. The inflating of the case can be done purposefully or by inadvertence. In the mat described in the DOS 2.018.605, the granules would be whirled around within the segments without any control so that the granules lose any benefit and effectiveness. The same would be the case for the mat described in the GB patent 1.095.311. In a mat described in the GB patent 2.148.093, the inner blanket with the fill of granules would fold and scramble when blown up as the sewing lines between the various segments build folding lines weakening drastically the structure of the bag containing the granules. Due to the scrambling of the bag, its protective function is totally destroyed. It also is almost impossible to re-adjust properly a mat scrambled inside an inflated case so as to restore its proper functional property. The same is particularly the case with the tubular mat as described in PCT/FR87/00115.

Therefore, it is another object of the invention to exclude the above mentioned disadvantages by a solution where the inventive mat is not handicapped in its function neither by inflating nor by vacuuming of the mat.

Another disadvantage of the known mats is that, when a vacuum is applied to the mat through the valve, the granules become so hard that their desired shock absorption properties are impaired. Indeed, the mechanical structure created within the case by the application of a vacuum has particularly good shock absorbing properties when pre-expanded polystyrene granules are used for the protection of the goods packaged with the mat. Under a very high vacuum, the structure compacted by the granules can, however, become so hard as to drastically lose the shock absorbing capacity while, in the same time, the supporting structure becomes particularly efficient.

Therefore, it is another objective of the present invention to optimally maintain the desired shock absorbing capacities as well as to ensure, at the same time, a rigid supporting structure.

To reach the above mentioned objectives, the present invention provides a mat wherein the filling material is captured in a bag comprising a double wall fabric.

In a preferred embodiment of the invention, it is advantageous that the distant or spacer threads of the double wall fabric are arranged one with respect to the other at a distance which is larger than the mean diameter of the granular particles and smaller or at least equal to the length of the spacer threads. It may be furthermore advantageous that the spacer threads of the double wall fabric are regularly arranged and equally laid out over the double wall fabric.

In an advantageous embodiment of the invention, the filling material comprises a compound body wherein the materials composing such a compound body present different mechanical properties. In that context, the invention provides that the compound body comprises at least two layers and that these layers are connected with each other at least by punctiform contacts.

In another embodiment of the invention, the mat of the before-mentioned kind comprises a case with two compartments, each having valve means and filled with filling materials such as granules having equal or different mechanical properties.

BRIEF DESCRIPTION OF THE DRAWINGS

The invention will now be described with reference to the annexed drawings in which.

DESCRIPTION OF THE PREFERRED EMBODIMENTS

Figure 1:
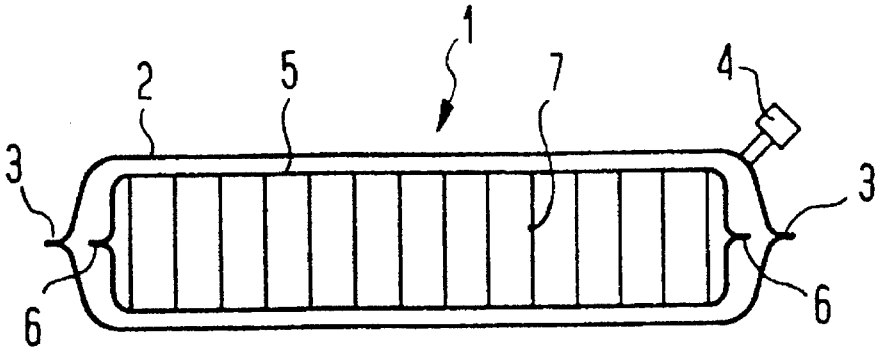
FIG. 1 is a cross-section of the invention in a first embodiment.

In the description which follows, the same reference numerals will be used to designate same or similar elements.

The mat 1 according to the invention comprises an air tight flexible case 2 welded along its circumference by an air tight border seam 3. By means of an adequate pump, a vacuum can be created within the case 2 through the valve 4. Within the case 2, there is located a textile bag 5 permeable to air and comprising a filling material such as granules, and, preferably, polystyrene granules.

This bag 5 comprises, according to the invention, a double wall fabric 5 closed along its circumference by a seam 6 so that a closed compartment is built between the two walls and in which the granules are captured and yet can move around freely. The granules essentially fill up almost totally the compartment built by the double wall fabric bag 5. The double wall fabric comprises an upper and a lower wall. These walls are connected to each other through a multitude of spacer or distant threads 7. These spacer threads are arranged in a distance to each other so that, in a microscopic perspective from the inside, the double wall fabric may be considered as a column hall.

Figure 2:
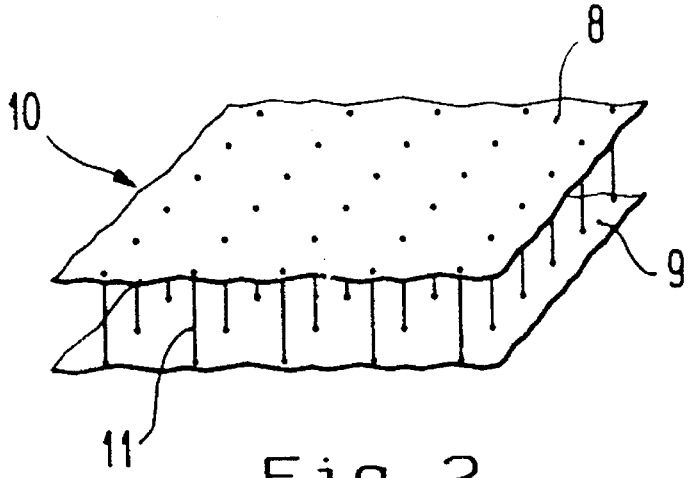
FIG. 2 is, schematically, a perspective of the double wall fabric according to the invention.

In the embodiment of the mat according to the invention shown in FIG. 2, the two walls 8 and 9 of the double wall fabric 10 are connected to each other by spacer threads 11. These threads 11 are arranged in a regular order in rows and at a regular distance one to the other. Due to this layout of the threads 11, the granules captured in a loose fill within the double wall fabric 10 can freely move through the spacer threads 11 and throughout the total compartment formed by this double wall fabric 10. This movement or migration of the granules during the pressureless state of the mat 1 is encouraged by the normal use of the mat and especially by shaking the mat. During these manipulations, the mat 1, however, constantly keeps its regular flat shape and there will be no accumulation, bulging or emptying in spots or areas of the mat.

Figure 3:
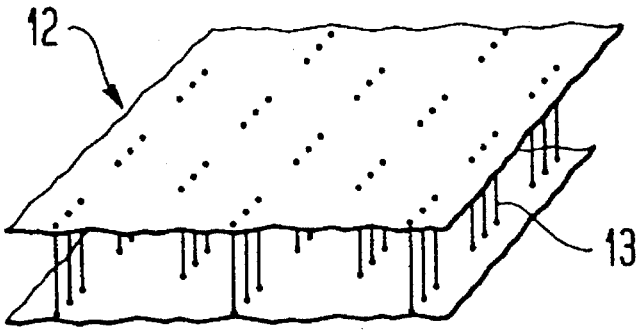
FIG. 3 is a perspective of the double wall fabric in another embodiment of the mat according to the invention.

In the embodiment of the invention shown in FIG. 3, the double wall fabric 12 of the mat 1 comprises spacer threads 13 which are arranged in groups in a row and the groups of threads 13 are offset one with respect to the other. With such an arrangement of the spacer threads 13, the granules within the double wall fabric 12 can particularly move well and mix throughout the compartment built by the double wall fabric 12, while the bag comprising the double wall fabric 12 does not lose its structure even when the case 2 is inadvertently or deliberately inflated through the valve 4. In fact, the regular flat structure of the bag comprising the double wall fabric 12 is totally maintained even when the case 2 is inflated. Even under such a condition, the bag comprising the double wall fabric 12 does not collapse, fold or scramble. All double wall fabrics have the advantage in common that the effective thickness of the mat 1 is determined by the length of the spacer threads as well as by their layout in the double wall fabric. As a general rule, and according to the invention, the distance between the spacer threads or groups of spacer threads should not be greater than the length of a spacer thread. Furthermore, the distance between spacer threads or groups of spacer threads should be such that the free migration or movement of the granules through the spacer threads is not hindered. So, for instance, the distance between the spacer threads of the double wall fabric of the bag should be larger than the mean diameter of the granules but smaller or equal to the length of the spacer threads.

The essential advantage of the mat 1 according to the invention is that the granules or particles are captured within the bag in a loose fill which has a positive effect on their constant mixing, increased longevity and equal mechanical stress. At the same time, however, the double wall fabric ensures a uniform geometry and stable structure of the mat. Also, the filling of the double wall fabric with granules is more easy and, thus, better to control, and needs less time and machinery and, therefore, is more economical. Furthermore, with the mat according to the invention, it is possible to realize circumferential shapes of the mat which are not bound or subject to any mandatory segment or tubular shape of the mats of the known art. So, it is perfectly possible with the mats of the invention to build circular, heart or any other shapes wherein the bag comprising the double wall fabric perfectly fills up the case until into the very extreme corners.

Figure 4:
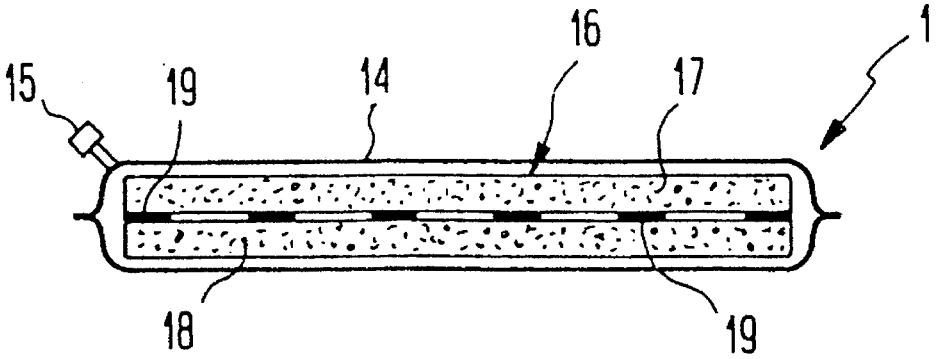
FIG. 4 is a cross-section of the mat according to another embodiment of the invention.

In the embodiment of the invention shown in FIG. 4, the mat 1 comprises a case 14 with a filling material built by a compound body 16. This compound body 16 comprises, preferably, two layers 17 and 18 consisting of materials having different mechanical properties. The layers 17 and 18 are connected one to the other at least in punctiform areas 19. But, it is also possible to connect the two layers over their common contact surface. According to the invention, the layer 17 comprises a bag as shown in FIG. 2 whereas the layer 18 comprises a so called airtight air bubble sheet material.

Figure 5:
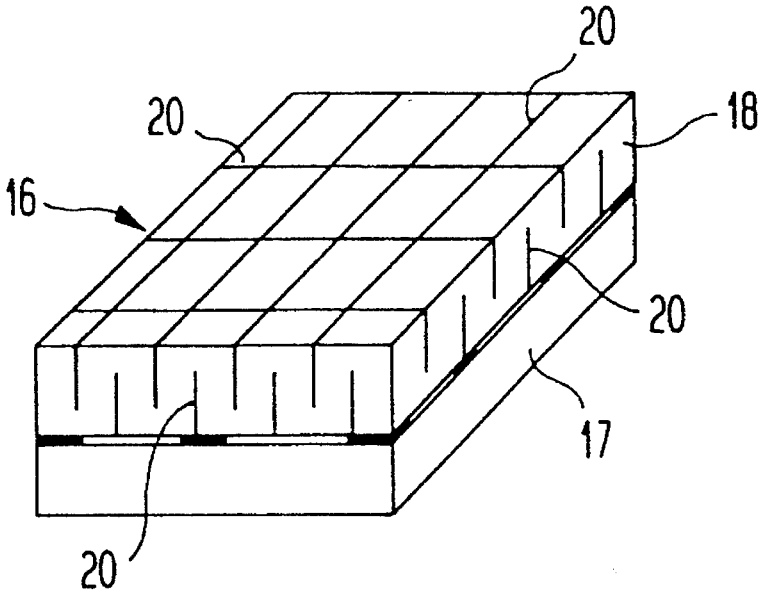
FIG. 5 is a perspective of the filling material in a mat according to another embodiment of the invention.

The layer 18 can also comprise a sheet of closed cell foam, the thickness of which is chosen depending on the desired cushioning effect. In order to create or preserve the flexibility of a thicker sheet of closed cell foam, this foam sheet may be slit by partial cross cuts 20, as shown in FIG. 5. These cuts are made on both sides of the layer 18 so that the foam sheet can freely flex three-dimensionally. It is also possible that the two layers 17 and 18 comprise bags according to the invention and contain granules having different mechanical properties. So, the layer 17 can comprise granules of pre-expanded polypropylene, whereas the layer 18 comprises incompressible granules.

With such an embodiment of the invention, the mat 1 has the advantage that either side of the mat 1 has different mechanical properties so that the user has the free choice of applying one or the other side of the mat to the goods to be packaged. In such an embodiment, one side of the mat has more cushioning effect whereas the other side has more supporting property. Also, the one layer comprising bubble sheet material or a foam sheet positively contributes to the geometrical structure of the filling material so that it does not collapse or fold when the case is inflated.

Figure 6:
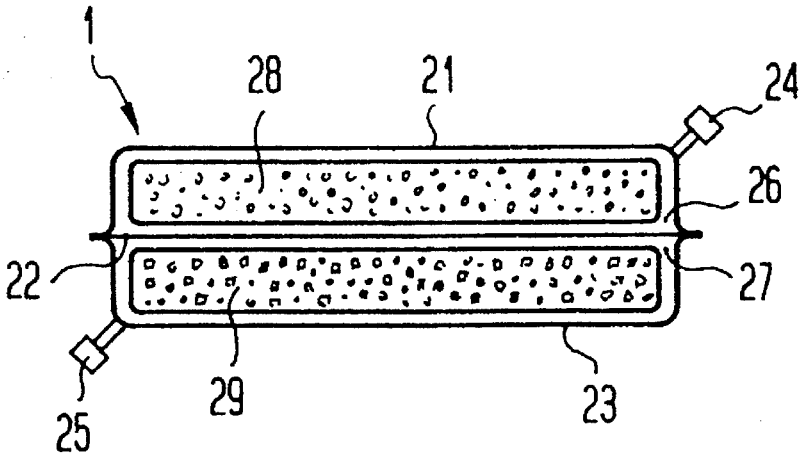
FIG. 6 is a cross-section of a mat in a particular embodiment of the mat according to the invention.

Continuing this idea of the invention, it may be an advantage that the bags are contained in one case, but in two separate compartments. So, the embodiment of the invention shown in FIG. 6 comprises a mat 1 with three walls 21, 22 and 23 welded together in such way that they build two compartments 26 and 27 each having a valve 24 and 25. In each of these compartments 26 and 27 is located a bag 28 and 29 comprising a double wall fabric. The granules captured in each bag 28 and 29 are homogenous for each bag, but different with respect to each other. Such granules may be consisting of pre-expanded polystyrene, cork flour, non elastic grains having an irregular outer shape such as octahedrons, latex granules or similar granules of rubber elastic consistency.

Such a combination of various filling materials has various advantages. Granules of pre-expanded polystyrene have the particular advantage to change under a low vacuum to a pasty consistency. When having this consistency, the mat 1 conforms perfectly well to the shape of the object to be wrapped and, at the same time, has a specifically good shock absorbing capacity as shocks coming from the outside are absorbed by plastic deformation and/or by friction between the granules. However, in this pasty consistency, the granules have a very poor or little supporting capacity which can only be reached by a higher vacuum. Therefore, the invention proposes to create different vacuums in the separate compartments 26 and 27 which leads to different mechanical properties of the compacted granules. If a sensibly lower vacuum is created in the compartments 26 as compared to compartment 27, the same polystyrene granules are soft and moldable on one side of the mat whereas the other side of the mat is hard and stiff. According to the invention, a highly delicate object is wrapped in the mat. In the compartment adjacent this object, a rather low vacuum is created so that the object is enclosed by a pasty moldable cushion. Subsequently, the outer compartment is depressurized by a very high vacuum so that the granules captured in this outer compartment are firmly compacted to a very rigid and supportive structure surrounding the soft and pasty granules like a hard shell but without noticeable pressure, thus supporting and protecting it efficiently.

According to the invention, the following combinations of materials have been proven of particular interest in practice: expanded polypropylene under different vacuums in both compartments with the advantage of light weight; expanded polypropylene in one compartment and non-compressible octahedral granules in the other compartment so that any desired soft consistency may be created on one side of the mat whereas the fill with the rigid octahedral granules produces a very stiff supporting structure; expanded polystyrene in one compartment and latex granules in the other compartment so as to create a soft structure on one side of the mat and a rubber elastic stable structure on the other side. By such combinations of different granules, it becomes possible to create the hard supporting structure with wear resistant granules whereas the sensitive and quickly wearing granules of polystyrene are taken care of by a lower vacuum. This dramatically increases the longevity and the proper function of this material which has good shock absorbing and weight advantages but very poor mechanical strength.

Also, although the invention has been described with reference to particular means, embodiments and materials, it is to be understood that the invention is not limited to the particulars disclosed and includes all embodiments and claims.

What is claimed is:

1. A mat for bearing and supporting an object comprising:

(a) a container defining at least one airtight and flexible compartment having at least one valve means connected to a source of vacuum for creating an evacuated condition within said compartment;

(b) at least one air-permeable bag disposed within said compartment, said bag comprising an upper wall and a lower wall joined in a manner to define an enclosed region, said upper wall and said lower wall being connected within said enclosed region by a plurality of spacer threads such that said bag has a thickness that is maintained substantially uniform; and (c) a granular material disposed within said enclosed region, said mat having a first, unevacuated condition and a second, evacuated condition, said granular material being of a granule size to permit said granular material to circulate freely within said region when said mat is in said first unevacuated condition, and said mat in said second, evacuated condition being adapted to secure said granular material in fixed positions within said enclosed region.

2. A mat as defined by claim 1 wherein the spacer threads are disposed in spaced relation at a predetermined distance that is greater than the mean granule diameter of the granular material and smaller than the length of the spacer threads.

3. A mat as defined by claim 1 wherein the spacer threads are disposed in spaced relation at a predetermined distance that is greater than the mean granule diameter of the granular material and equal to the length of the spacer threads.

4. A mat as defined by claim 1 to 3 wherein the spacer threads are laid cut in an equidistant pattern.

5. A mat as defined by claim 1 to 3 wherein the spacer threads are laid out in rows.

6. A mat as defined by claim 1 to 3 wherein the spacer threads are laid out in groups and wherein the groups are offset one with respect to the other.

7. A mat for bearing and supporting an object, comprising:

(a) a container defining at least one airtight and flexible compartment having at least one valve means connected to a source of vacuum for creating an evacuated condition within said compartment;

(b) at least one air-permeable bag disposed within said compartment, said bag comprising an upper wall and a lower wall joined in a manner to define an enclosed region, said upper wall and said lower wall being connected within said enclosed region by a plurality of spacer threads such that said bag has a thickness that is maintained substantially uniform;

(c) a granular material disposed within said enclosed region, said mat having a first, unevacuated condition and a second, evacuated condition, said granular material being of a granule size to permit said granular material to circulate freely within said region when said mat is in said first, unevacuated condition, and said mat in said second, evacuated condition being adapted to secure said granular material in fixed positions within said enclosed region; and further comprising a layer in opposed, spaced relationship to said bag such that said bag and said layer have opposed, inwardly facing surfaces, and said layer is connected to said bag over at least a portion of said inwardly facing surfaces such that said bag and said layer form a compound body.

8. A mat as defined in claim 7 wherein said granular material in said bag has mechanical properties different from mechanical properties of said layer.

9. A mat as defined in claim 7 wherein said layer comprises a second bag permeable to air, said second bag comprising an upper wall and a lower wall joined in a manner to define a second enclosed region, said upper wall and said lower wall being connected within said enclosed region by a plurality of spacer threads such that said bag has a thickness that is maintained substantially uniform, and a granular material is disposed within said second enclosed region.

10. A mat as defined in claim 7 wherein said layer comprises a sheet of airtight material having a plurality of air bubbles formed therein.

11. A mat as defined in claim 7 wherein said layer comprises a sheet of closed cell foam.

12. A mat as defined in claim 11 wherein the layer of closed cell foam has partial slits arranged in transverse cross cut pattern.

13. A mat for bearing and supporting an object, comprising:

(a) a container defining at least one airtight and flexible compartment and a separate, second compartment, each said compartment having at least one valve means connected to a source of vacuum for creating an evacuated condition within said compartment;

(b) at least one air-permeable bag disposed within each said compartment, said bag comprising an upper wall and a lower wall joined in a manner to define an enclosed region, said upper wall and said lower wall being connected within said enclosed region by a plurality of spacer threads such that said bag has a thickness that is maintained substantially uniform;

(c) a granular material disposed within said enclosed region, said mat having a first, unevacuated condition and a second, evacuated condition, said granular material being of a granule size to permit said granular material to circulate freely within said region when said mat is in said first, unevacuated condition, and said mat in said second evacuated condition being adapted to secure said granular material in fixed positions within said enclosed region; and said bag comprising an upper wall and a lower wall joined in a manner to define an enclosed region, said upper wall and said lower wall being connected within said enclosed region by a plurality of spacer threads such that said bag has a thickness that is maintained substantially uniform, and a granular material disposed within said region.

14. A mat as defined in claim 13 wherein the granular material within each respective region is homogeneous, and the granular material within the region of said first compartment has the same mechanical properties as the granular material in the region of said second compartment.

15. A mat as defined in claim 13 wherein the granular material within each respective region is homogeneous, and the granular material within the region of said first compartment has mechanical properties which differ form mechanical properties of the granular material within the region of said second compartment.

16. A mat as defined by claim 4 wherein the spacer threads are laid out in groups and wherein the groups are offset one with respect to the other.

17. A mat as defined by claim 5 wherein the spacer threads are laid out in groups and wherein the groups are offset one with respect to the other.

* * * * *